US005315849A

United States Patent [19]

Georgopoulos

[11] Patent Number: 5,315,849

[45] Date of Patent: May 31, 1994

[54] BOX LOCK CONSTRUCTION

[75] Inventor: George Georgopoulos, Pine Brook, N.J.

[73] Assignee: E. J. Brooks, Newark, N.J.

[21] Appl. No.: 27,385

[22] Filed: Mar. 8, 1993

[51] Int. Cl.[5] ..... E05B 67/36

[52] U.S. Cl. ..... 70/34; 70/63; 70/159

[58] Field of Search ..... 70/32-34, 70/63, 77, 78, 177, 232, 158-173; 292/256, 258, 288, 340

[56] References Cited

U.S. PATENT DOCUMENTS

| | | | |
|---|---|---|---|
| 3,968,985 | 7/1976 | Nielsen, Jr. et al. | 70/63 X |
| 4,031,722 | 6/1977 | Michelman et al. | 70/63 |
| 4,049,313 | 9/1977 | Lundberg | 70/77 X |
| 4,080,811 | 3/1978 | Nielsen, Jr. | 292/256 X |
| 4,096,718 | 6/1978 | Michelman et al. | 70/63 |
| 4,107,959 | 8/1978 | Skarzynski et al. | 70/159 |
| 4,120,182 | 10/1978 | Michelman et al. | 70/63 |
| 4,120,183 | 10/1978 | Walters | 70/63 X |
| 4,313,319 | 2/1982 | Haus, Jr. et al. | 70/34 |
| 4,551,999 | 11/1985 | Guiler | 70/63 X |
| 5,007,258 | 4/1991 | Mahaney | 70/34 X |

*Primary Examiner*—Peter M. Cuomo
*Assistant Examiner*—Suzanne L. Dino
*Attorney, Agent, or Firm*—William Squire

[57] ABSTRACT

A utility meter box lock construction includes a male assembly having a male body which is bolted to the front wall of the utility meter box with a threaded bolt having an annular groove which is locked to the male body by a set screw. The lid is secured in place in a closed condition by a conventional utility plunger lock which is assembled to a female assembly having a bore which aligns with a bore in the male body. A threaded insert is threaded to the male body in the bore which is aligned with a second bore in the female assembly for receiving the plunger lock. The balls of the plunger lock are expandable to an extension locking state for mating with a groove in the insert threaded to the male body. The position of the plunger balls is set along the plunger bore by rotation of the threaded insert for ensuring that the female member with a lid-locking flange closely closes the lid of the box to the box sidewalls. The set screw for locking the male assembly bolt in place is located within the female assembly body to preclude access by a tamperer. The female body includes an L-shaped flange with a steel L-shaped insert, the body of the female assembly being made of molded nylon. A padlock-type seal is secured over the installed plunger lock to preclude further tampering.

23 Claims, 3 Drawing Sheets

66
64
62
66
70
72
34
50
52
52
48
54
44
114
116
52'
14
45
42
38
36
90
74
88
82
86
84
76
46
58
56
60
40
40
94
98
78
80
100
92
96
102
104

52
66
62
48
110
44
24
96
50
54
90
42
84
92
94
40
56
36
102
74
46
60
20
106
98

BOX LOCK CONSTRUCTION

This invention relates to locks for use with electric meter boxes, which utilize a plunger-type lock with expansible ball locking elements.

Electric meters are enclosed in boxes or other enclosures to preclude the theft of utility services. The theft of electricity by tampering with or bypassing electric meter connections enclosed in these boxes is widespread. Further, electric meters are enclosed to preclude tampering and possible injury to personnel as a result of such tampering. As a result, there has evolved lock arrangements for locking the boxes to preclude tampering and access to the electric utility meters enclosed therein. An example of a locking device for electric meter boxes is disclosed in U.S. Pat. No. 4,254,647. Disclosed therein is a forced-resistant locking device for electric meter boxes with hinged covers or the like. The locking device comprises a stud member mounted to a wall of the box and a flange member received on the stud member. The flange member includes a flange overlying a marginal portion of the cover to keep it closed. The flange and stud members together define an opening receiving and fully enclosing a utility lock of a plunger-type for securing the flange and stud members together.

However, the present inventor recognizes a problem with such a device. Persons attempting to steal electricity from a utility meter enclosed in such a box still, through clever arrangements, are able to bypass such a lock. For example, the stud and flange member in the locking device are each secured in fixed relationship due to the utility plunger lock. The stud member, in turn, is fixed to the front wall, for example, of the utility box with a threaded bolt. Removal of the threaded bolt then defeats the locking arrangement. For example, the thief can penetrate the bottom wall of the box with a small, unobtrusive opening, access the threaded bolt with a wrench and remove the bolt in an unobtrusive manner and hook up wiring to steal electricity. The locking device can be returned to its normal appearance and, therefore, it would be undetected that electricity is being stolen. Further, because a stud member is fixed to the box in a fixed relationship by the bolt, the cover locking flange is also fixed to the stud by the fixed relationship of the plunger. It may occur that the cover is not always tightly secured onto the sidewalls of the box. If there is any clearance therebetween, thieves can enter the box and, again, remove the threaded bolt and steal electric service.

It is important, as recognized by the present inventor, to preclude tampering with the box in as many different possible ways as possible so that any attempt of tampering is visibly noticeable and the theft can be stopped at that time. The problem, therefore, as is recognized by the present inventor, is not only locking the box but preventing obscure tampering with the box so that the theft of services cannot be accomplished in an unnoticeable way.

SUMMARY OF THE INVENTION

A lock construction, in accordance with one embodiment of the present invention, for locking a box with a utility lock of the type including a head, a shaft and locking means secured to the shaft and spaced from the head a given, pre-determined distance, includes a bottom, a rear wall, a front wall, opposing sidewalls and a lid secured to the rear wall and having open and closed lid conditions. The construction for locking the lid closed comprises a male member adapted to be secured to and project from one of the side and front walls. The member has a first lock receiving opening aligned on an axis. A female member has a male member receiving opening and flange portion dimensioned to be juxtaposed with at least a portion of the lid in the closed lid condition when the male member is received in the male member receiving opening. The female member has a second lock receiving opening. The first and second lock receiving openings are aligned when the male and female members are engaged for receiving the utility lock. Adjustment means include means for releaseably receiving the utility lock locking means. The adjustment means are adjustably secured to one of the male and female members for adjusting the relative positions of the male member to the female member along the axis when locked by the utility lock. Therefore, the adjustment means can adjust the position of the male and female members as locked by the utility lock to therefore ensure that the lid is tightly closed on the box to preclude tampering.

In accordance with a second embodiment, the male member has a threaded opening on a first axis. The member has a first lock receiving opening lying on a second axis transverse the first axis. A pin receiving opening is in the male member in communication with the threaded opening. A pin is located in the pin receiving opening. A bolt is engaged with the threaded opening and includes recess means which selectively receive the pin in the pin receiving opening wherein the pin, when engaged with the recess means, locks the bolt to the male member. A female member has a male member receiving opening and a flange portion arranged to be juxtaposed with at least a portion of the lid in a closed lid condition when the male is engaged with the male member receiving opening. The female member has a second lock receiving opening, the first and second lock receiving openings being aligned when the male and female members are engaged. The aligned openings receive the utility lock and are arranged to be selectively locked together by the utility lock for locking the lid closed with the flange portion whereby the pin precludes disengagement of the bolt in the lid-closed locked condition.

IN THE DRAWING

DESCRIPTION OF THE PREFERRED EMBODIMENTS

Figure 1:
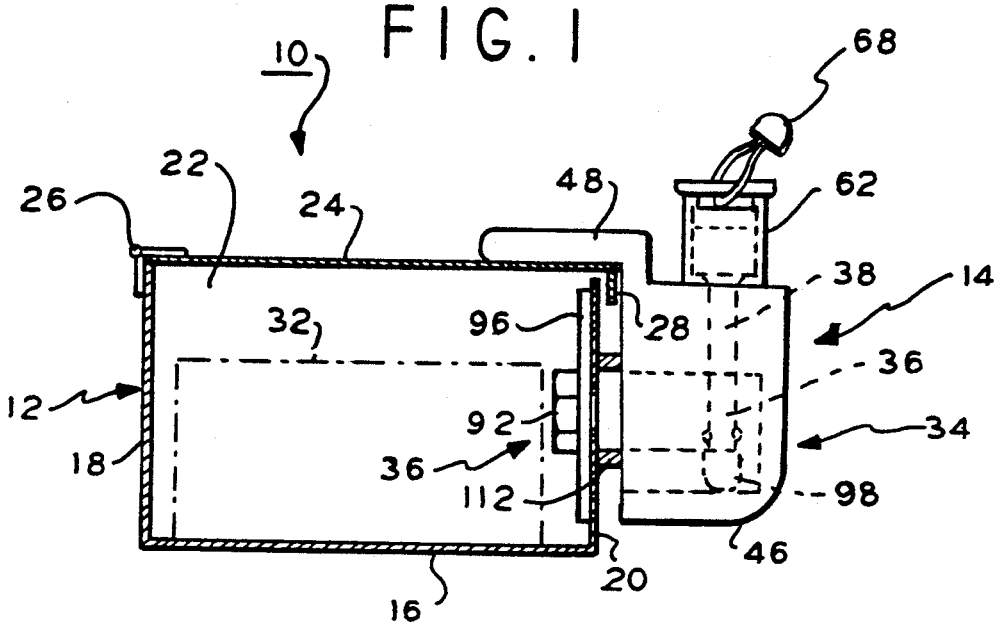
FIG. 1 is a side-elevation view of a lock construction in accordance with one embodiment of the present invention with a sectional view of the box to which the lock is attached.
Figure 2:
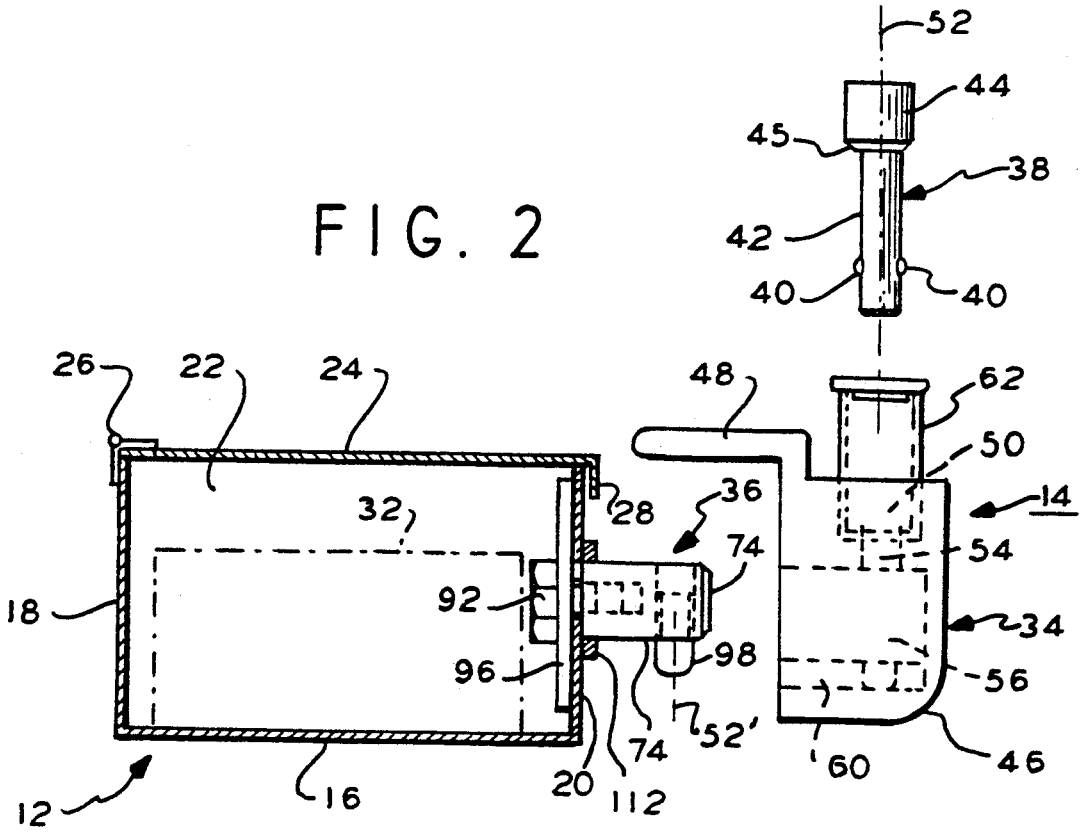
FIG. 2 is an exploded view of the embodiment of FIG. 1.

In FIGS. 1 and 2, an electric utility meter enclosing box assembly 10 comprises a steel box 12 and a lock 14 according to an embodiment of the present invention for locking the box 12. The box 12 comprises a bottom 16 and a plurality of sidewalls, including a rear wall 18, a front wall 20, and opposing sidewalls 22, only one of which is shown in FIGS. 1 and 2. A lid 24 is hinged to rear wall by hinge 26. The lid 24 has a depending flange 28. Located inside the utility box and locked therein by the lock 14 is an electric utility meter 32, shown in phantom.

The lock 14 comprises a female assembly 34 and a male assembly 36. The female assembly 34 and male assembly 36 are locked together by a conventional utility lock 38. Lock 38 is of the plunger type and has a pair of balls 40 which have an extended state as shown in FIG. 2 and a retracted state where they are flush or recessed within the shaft 42 of the plunger body. Lock 38 also includes a head 44, which is of larger diameter than the shaft 42. The balls 40 are activated to the extended condition of FIG. 2 by a key (not shown), which is standard. Various manufacturers make the lock 38 and they come in a variety of sizes and dimensions. The larger diameter head 44 and the extended balls 40, when mated with the lock 14, engage various surfaces thereof to lock the female assembly 34 to the male assembly 36.

Figure 3:
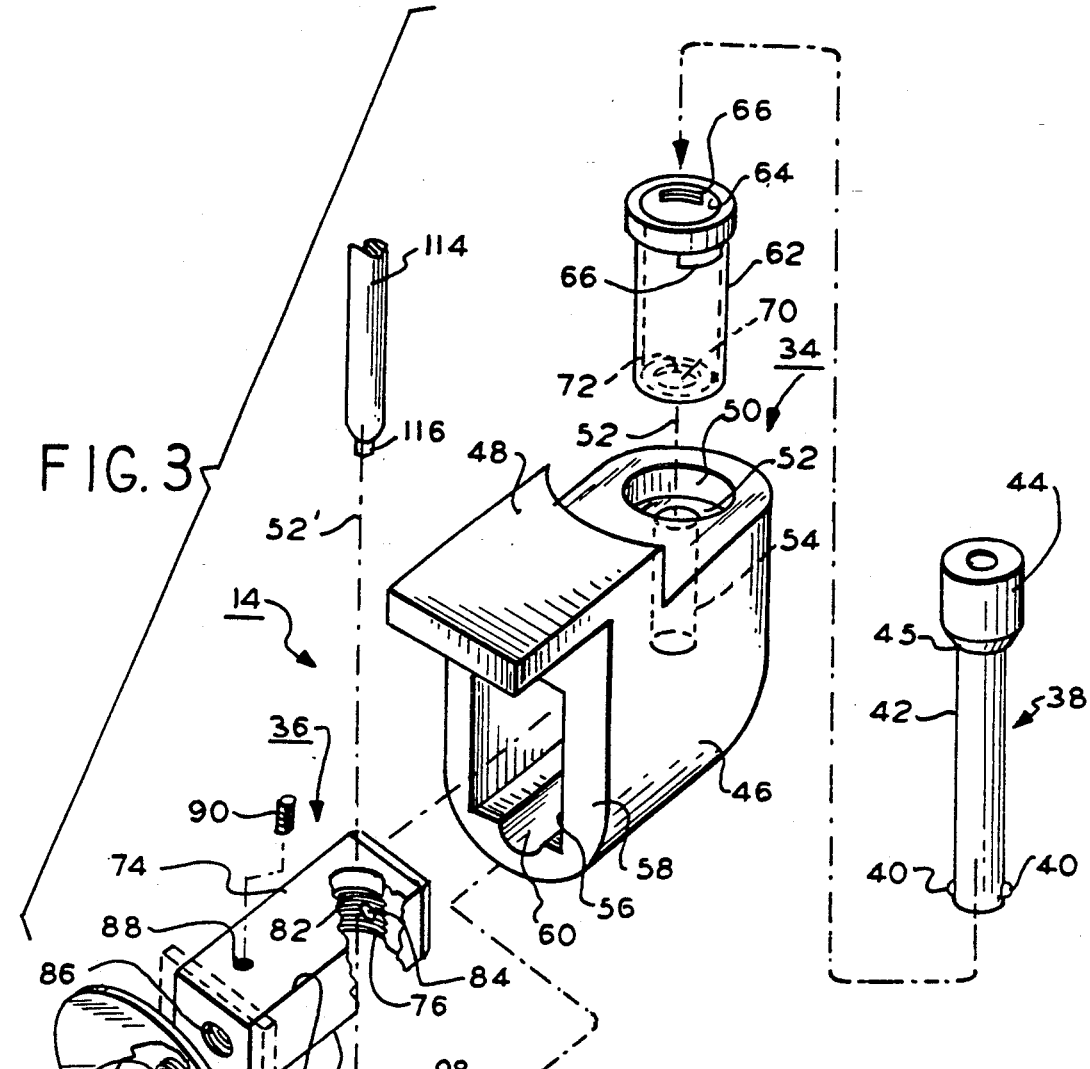
FIG. 3 is an exploded view of the lock portion of the embodiments of FIGS. 1 and 2 illustrating the various components of the lock construction.

In FIG. 3, the female assembly 34 includes a molded, nylon body 46. In the alternative, the body 46 may be all steel. An L-shaped flange 48 extends from the upper region of the body 46. The body 46 has a stepped bore 50 lying on an axis 52, transverse to the plane of the flange 48. The bore 50 has a shoulder 52 in the body 46 and continues in a smaller diameter bore 54, all being concentric with axis 52. The body 46 has a transverse, generally rectangular, bore 56 open at end 58 and closed at the opposing end of the body 46. The bore 56 is in communication with the bore 54 and is aligned therewith. An arcuate groove 60, which may be a segment of a circle, is formed in the bottom of the bore 56 and extends for the length of bore 56 past axis 52 and aligned with bore 54.

A molded thermoplastic, tubular insert 62 is closely received in bore 50 and rests on shoulder 52. The insert 62 has a bore 64 which is aligned on axis 52 and is dimensioned to closely receive the head 44 of the lock 38. Bore 54 is also dimensioned to closely receive the shaft 42 of the lock 38. A pair of opposing slots 66 are formed in the side of the insert 62 for receiving a security seal 68, FIG. 1. Insert 62 has a smaller bore 70 at its lower end, forming a shoulder 72. The plunger head 44, FIG. 2, has a shoulder 45, which rests on shoulder 72 of the insert 62 and locks the insert 62 to the body 46 when the lock 38 is locked in place.

The male assembly 36 of lock 14 comprises a steel body 74 generally square in transverse section. The body 74 has a bore 76 extending between an upper surface 78 and lower surface 80. The bore 76 lies on axis 52'. The bore 76 is partially threaded in communication with surface 80 and the threads terminate spaced from surface 80. Located in communication with the threads 82 of bore 76 is a nylon insert 84. The insert 84 is optional and serves to lock the mating member to be described below and can be used in the alternative with other locking materials as known in the art for securing a threaded member to its threads. Body 74 is dimensioned around its periphery so as to be slideably received within the bore 56 of the female body 46. When so inserted, the axis 52' of bore 76 of the male member body 74 is aligned coaxial with axis 52 of bores 50 and 54 of the female body 46.

A threaded bore 86 is in body 74 (transverse to axis) 52' in communication with an end of body 74. An additional threaded bore 88 is parallel to axis 52' and is in communication with bore 86 for receiving a set screw 90. The set screw 90, when received in bore 88, can be adjusted to enter bore 86. A threaded bolt 92 has an annular groove 94, which is aligned with bore 88 of the set screw 90 when the bolt is inserted in and threaded to the body 74 threads in bore 86. A relatively large diameter washer 96 is interposed between the head of the bolt 92 and the mating front wall 20 of the electric utility box 12, FIG. 1.

Figure 6:
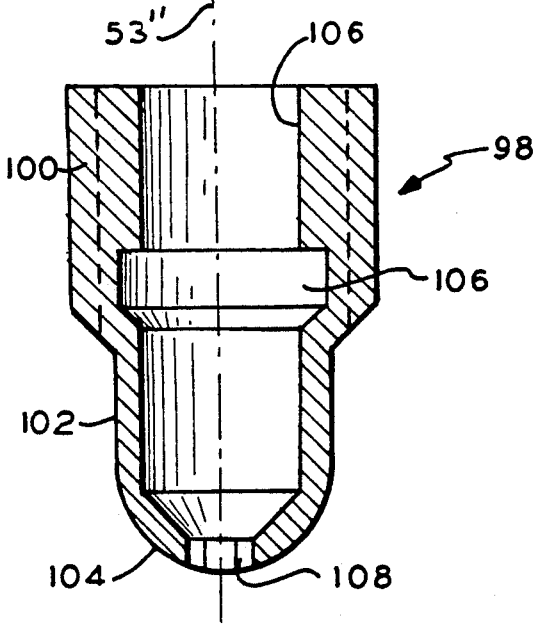
FIG. 6 is a side-elevation sectional view of an adjustment element used in the embodiment of FIGS. 4 and 5, which allows the male and female members to be locked to different relative distances.

An insert 98 having external threads 100 includes a lower depending, narrower diameter extension 102 with a spherical bottom surface 104. In FIG. 6, insert 98 has a bore 106 of such a diameter so as to closely receive the shaft 42 of the plunger 38, FIG. 2, on axis 53". An annular groove 106 is formed in the insert medial opposing ends along axis 53". The bore 106 is concentric with axis 53" and terminates adjacent to the curved bottom surface 104. A hexagonal opening 108 is formed in the bottom surface 104 in communication with bore 106. The opening 108 lies on axis 53". The external threads 100 of insert 98 mate with the internal threads 82 of bore 76 in the male body 74. Because the threads 82 are only partially within the bore 76, the insert 98 is only partially threaded into the body 74. The purpose of this is to prevent the insert 98 from being removed through the upper portion of opening 76 adjacent to the upper bore 50 in the body 46 of the female assembly. This is to preclude a thief from removing the insert 98 through the bores 50 and 54. The nylon insert 84 in the body 74, FIG. 3, locks the insert 98 in place to be prevent it being loosened by vibrations, banging, shaking, and the like, by a potential thief. In FIG. 6, the annular groove 106 is dimensioned to receive and lock the extended balls 40 of the lock 38 thereto.

Figure 4:
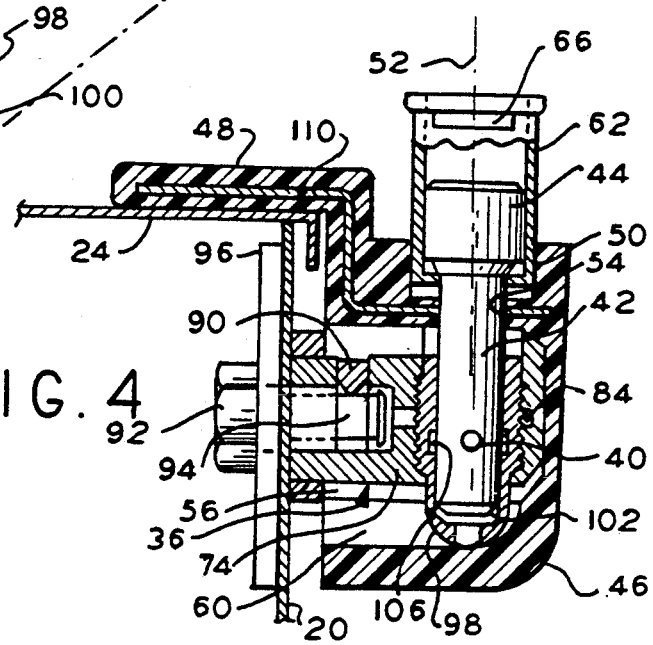
FIG. 4 is a sectional side-elevation view similar to the view of FIG. 1 of the lock construction.

In FIG. 4, the flange 48 of body 46, when formed of molded nylon, includes an L-shaped steel reinforcing member 110. The member 110 serves as an additional protective device for preventing breakage and tampering of the flange 48 of the female assembly 34. In the alternative, the female body 46 may be entirely metal, for example, steel or other metals. By providing a nylon body 46 with a steel reinforcing member 110, the lock 14 is less costly to manufacture as compared to an all-metal body 46. In the case that tampering is evident with the lock 14 employing a nylon body 46, then the utility company can replace the lock 14 with an all-metal body 46, which will further resist tampering.

In FIG. 2, the male assembly 36 is secured to the front wall 20 of the box 12 with the bolt 92 and washer 96, as shown. Optional is a metal spacer ring 112, which fits around the body 74. The spacer ring 112 spaces the female body 46 from the front box wall 20. The ring 112 is square in shape and fits closely in press-fit engagement over the outer surface of the end of body 74 next to the wall 20.

The set screw 90, as best seen in FIG. 4, is assembled to threaded aperture 88 of the body 74 and engaged with the annular groove 94 of bolt 92, locking the bolt 92 to the body 74. The body 74 is thus tightly secured by the bolt 92 to the front wall 20 of the box 12. At this time the insert 98 axis 53" is coaxial with axis 52', FIG. 2.

The thermoplastic molded insert 62 is inserted in bore 50 of the body 46, where it is frictionally held in place. The insert 98 is threaded into the threaded bore 76 of the body 74 of the male member. The downwardly projecting insert 98 extension 102 is received in the groove 60 of the body 46, as seen in FIG. 4.

The female assembly 14 is then assembled to the male assembly 36 by inserting the male body 74 into the bore 56 of the female assembly. Flange 48, at this time, overlaps a portion of the lid 24. The plunger lock 38 is inserted into the insert 62 and into the female assembly 34 bores 50 and 54 with a key (not shown). The balls 40 of the lock 38 are aligned with the internal groove 106 of the insert 106. When the key is removed, the balls 40 expand and engage with the insert 98 groove 106. The head 44 and balls 40 thus lock the female assembly 34 to the male assembly 36. However, the spacing between the head 44 of the lock 38 and the balls 40 is fixed. As a result, there might be a gap 114 (FIG. 5) between the lid 24 and the front wall 20 and the sidewalls 22 (not shown in FIG. 5). This gap could permit a tamperer to force the lid open in a manner to attempt to enter the interior of the box 12. This is undesirable.

Figure 7:
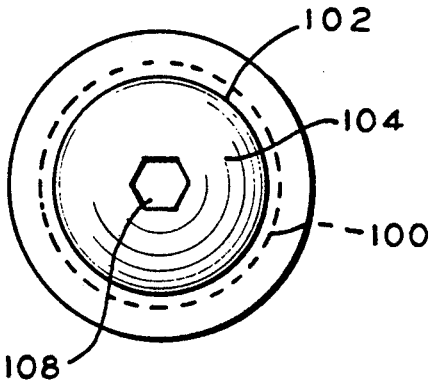
FIG. 7 is a bottom plan view of the element illustrated in FIG. 6.

The reason for this gap is that the location of the groove 106 of the insert 98 locates the balls 40 relative to the male assembly 36. The shoulder formed by the head 44 of the lock 38 locates the position of the female assembly 34 along axis 52. In the prior art, the location of the locking shoulder, such as formed by groove 98 or a similar recess for receiving the balls 40 of the lock 38, are in fixed relationship to the female assembly. Therefore, a gap such as gap 114 exists due to dimensional variations from box to box and lock to lock. In accordance with the present invention, the insert 98 is adjustable along the axis 52 and aligned therewith so as to position the annular groove 106 along the axis 52 for receiving the lock balls 40 relative to the body 74 of the male assembly 36. To reduce the gap 114 or eliminate it entirely, the threaded insert 98 is rotated via its threaded engagement with the body 74 to move the groove 106 further away from the flange 48. This means moving the insert 98 towards the bottom of the drawing figure of FIG. 5. The way this is done is a tool 114, FIG. 3, having a male hex end 116 is inserted into insert 98 female hex opening 108 (FIG. 7) through bores 50 and 54. The tool 114 manually rotates the insert via its threaded engagement with the male body 74 to lower the insert relative to that body. This also will lower the position of the engagement of the balls 40 of the lock 38 with the insert and, thus, relative to the male assembly 36. Because the lock 38 has fixed dimensions between its head 44 and balls 40, this will automatically cause the female assembly to be lowered as well a comparable distance, closing the gap 114, as illustrated in FIG. 4. The insert 98 can thus be adjusted to ensure that the lid 24 is tightly closed on the sidewalls.

Once it is so adjusted, the tool 114 is removed and the lock 38 is assembled so the balls 40 are aligned with the insert groove 106. At this time, the key is removed from the plunger of lock 38 and the balls 40 expand into a locking extended position, locking the lock 38 to the insert 98. Thus, the female assembly is locked to the male assembly at this time with the lock 38 encased as shown.

Figure 5:
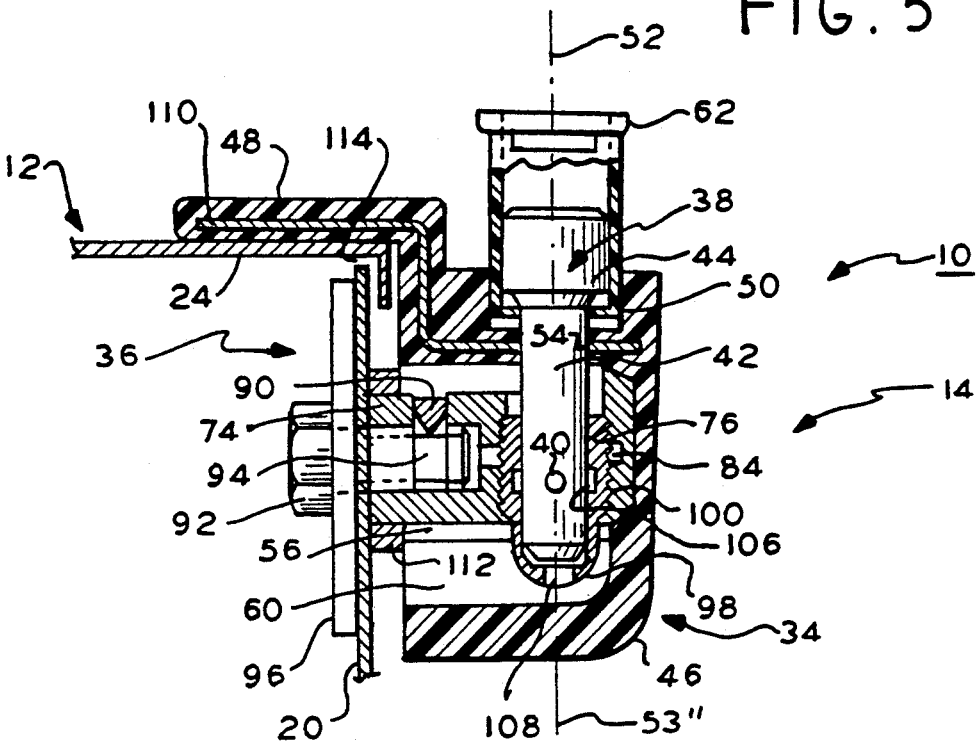
FIG. 5 is a side-elevation sectional view of the lock construction similar to the view of FIG. 4 illustrating a settable different spacing achieved by the adjustment elements of the lock construction.

Because the set screw 90, FIG. 4, locks the bolt 92 to the male body 74, any tampering attempt to remove the bolt 92 from within the box is futile because the bolt 92 cannot be removed due to the presence of the set screw 90. Any vibrations or shaking of the assembly in an attempt to cause the insert 98 to loosen and thus cause the lock assembly to loosen to the position of FIG. 5 is precluded via the nylon insert 84 or similar device for locking the threads of the insert 98 in place. While attempts to preclude tampering require further improvements and is recognized that one desiring to open an electric utility box may do so with whatever means available, the present lock arrangement, in accordance with the present invention, is arranged such that any attempt at tampering will be immediately evident to a utility inspector and can, thus, eliminate the theft of utility service at this time. It may be impossible to stop the theft, but it is most desirable to provide a tamper-resistant locking arrangement which is self-revealing of tampering and precludes unobtrusive tampering for the purpose of stealing electricity from the lock meter arrangement.

While various embodiments have been described herein, it should be appreciated that the scope of the present invention is as defined in the appended claims herein. The described embodiments are given by way of example and not by way of limitation. It will be apparent to those of ordinary skill in the art to make various modifications to the disclosed embodiment without departing from the spirit of the invention as defined in the appended claims.

What is claimed is:

1. A lock construction for locking a box with a utility lock of the type including a head, a shaft and expansible locking means secured to the shaft and spaced from the head a given, predetermined distance, said box including a bottom, a rear wall, a front wall, opposing sidewalls and a lid secured to the rear wall and having open and closed lid conditions, said construction for locking the lid closed and comprising:

a male member adapted to be secured to and project from one of said side and front walls, said member having a first utility lock receiving opening lying on a first axis;

a female member having a male member receiving opening and including a flange portion dimensioned to be juxtaposed with at least a portion of said lid in the closed lid condition when said male member is received in said male member receiving opening, said female member having a second lock receiving opening along a second axis said first and second lock receiving openings being coaxially aligned when the male and female members are engaged for receiving said utility lock along said axes; and adjustment means including means for releaseably receiving said utility lock locking means, said adjustment means being disposed along said axes and adjustably secured to one of said male and female members for adjusting the relative positions of said male member to said female member along said axis when locked by said utility lock.

2. The construction of claim 1 including a threaded bolt for securing said male member to said one side, said bolt including pin receiving locking means for releasably locking the bolt to said male member with mating pin means.

3. The construction of claim 2 wherein said pin means comprises a set screw and said pin receiving locking means includes a recess in said bolt for receiving said set screw, said male member including said set screw, said recess being positioned within said male member receiving opening such that said set screw is only accessible when said male and female members are disengaged.

4. The construction of claim 1 wherein said adjustment means includes a hollow core insert threaded to said female member, said core being dimensioned to receive said shaft, said shaft locking means comprising expansible balls, said insert including an annular groove adapted to engage said balls when expanded for locking the shaft to said insert.

5. The construction of claim 4 wherein the insert includes tool receiving means for receiving an insert adjustment tool.

6. The construction of claim 5 wherein the tool receiving means comprises a female opening in said insert dimensioned to receive and engage a male tool for rotating said insert relative to said female member.

7. The construction of claim 1 wherein said female member comprises molded thermoplastic material, said female member including a metal insert in said flange portion and extending transverse to said axis about said second lock-receiving opening.

8. The construction of claim 1 wherein the female member is metal.

9. The construction of claim 8 wherein the female member and the male member are steel.

10. The construction of claim 9 further including a tamper-resistant seal receiving member in said second lock receiving opening and adapted to be locked to said female member by said utility lock.

11. The construction of claim 4 including means for precluding vibration-loosening of said hollow core insert relative to said female member.

12. A lock construction for locking a box with a utility lock of the type including a head, a shaft and expansible locking means secured to the shaft and spaced from the head a given predetermined distance, said box including a bottom, a rear wall, a front wall, opposing side walls and a lid secured to the rear wall and having open and closed lid conditions, said construction for locking the lid closed and comprising:

a male member having a threaded opening on a first axis, said member having a first lock-receiving opening lying on a second axis transverse to the first axis;

a pin receiving opening in said male member in communication with said threaded opening;

a pin in said pin receiving opening;

a bolt engaged with said threaded opening and including recess means which selectively receives said pin in said pin receiving opening wherein the pin, when engaged with said recess means, locks the bolt to said male member; and a female member having a male member receiving opening and a flange portion arranged to be juxtaposed with at least a portion of said lid in the closed lid condition when said male member is engaged with said male member receiving opening, said female member having a second lock receiving opening, said first and second lock receiving openings being aligned when the male and female members are engaged, said aligned openings for receiving said utility lock and arranged to be selectively locked together by said utility lock for locking said lid closed with said flange portion whereby said pin precludes disengagement of said bolt in the lid closed locked condition.

13. The construction of claim 12 wherein the pin receiving opening of said male member is dimensioned to be located inside said male member receiving opening when the male and female members are engaged.

14. The construction of claim 13 wherein the pin receiving opening comprises a threaded hole for receiving a screw, said pin comprising said screw.

15. The construction of claim 12 further including adjustment means secured to one of said male and female members for adjusting the relative positions of said male member to said female member to lock the lid closed in tight engagement with said front and side walls.

16. The construction of claim 15 wherein said adjustment means comprises an insert secured to said female member and aligned with said first and second lock receiving openings, said insert being adapted to be selectively locked to said expansible locking means, and arranged for selective displacement along said second lock receiving opening.

17. The construction of claim 16 wherein said second lock receiving opening is at least partially threaded, said insert having threads which engage with the threads of said second lock receiving opening, said threaded opening and insert being arranged so that said insert can only be attached to said second lock receiving opening at a region thereof distal said first lock receiving opening.

18. The construction of claim 17 wherein the insert has a tool receiving opening arranged to engage an insert adjustment tool selectively inserted in said first and second lock receiving openings for selectively adjusting the position of said insert in said female member along said second lock receiving opening.

19. A lock construction for locking a box lid with a plunger lock of the type including a head, a shaft and expansible locking balls having a retracted unlock state and an extended lock state, said balls having a fixed spacing from said head, said box including a bottom, a plurality of side walls, a rear wall and a front wall, said construction comprising:

a male member adapted to be secured to and project outwardly from one of said side and front walls, said member having a first utility lock receiving opening lying on an axis;

a bolt for securing said member to said one side and front walls;

pin means for selectively engaging and locking the bolt to said male member such that said bolt is precluded from disengaging said male member from within said box; and a female member including a flange for locking said lid to said walls in a closed, locked state and adapted to receive said male member in said closed state and disengage said male member in a lid open state, said means for selectively locking being inaccessible for unlocking the lid in said lid locking state, said male and female members each including an opening for receiving said plunger lock and arranged such that said plunger lock selectively locks the male and female members together.

20. The construction of claim 19 further including an insert adjustably secured to said male member for selectively adjusting the spacing between said flange and said bolt to lock the lid in a tightly closed lock state in response to locking by said plunger lock.

21. The construction of claim 20 wherein the insert is threaded to said male member and including means for engaging said locking balls in the extended lock state.

22. The construction of claim 21 wherein said means for engaging said locking balls comprises an annular groove in said insert.

23. A lock construction for locking a box lid with a plunger lock of the type including a head, a shaft and expansible locking balls having a retracted unlock state and an extended lock state, said balls having a fixed spacing from said head, said box including a bottom, a plurality of side walls, a rear wall and a front wall, said construction comprising:

a male member adapted to be secured to and project outwardly from one of said side and front walls, said member having a first lock receiving open lying on an axis;

a bolt for securing said member to said one side and front walls;

means for selectively locking the bolt to said male member such that said bolt is precluded from disengaging said male member from within said box;

a female member including a flange for locking said lid to said walls in a closed, locked state and adapted to receive said male member in said closed state and disengage said male member in a lid open state, said means for selectively locking being inaccessible for unlocking the lid in said lid locking state, said male and female members each including an opening for receiving said plunger lock and arranged such that said plunger lock selectively locks the male and female members together; and an insert adjustably secured to said male member for selectively adjusting the spacing between said flange and said bolt to lock the lid in a tightly closed lock state in response to locking by said plunger lock.

* * * * *